US010506907B2

(12) United States Patent
Bertsch et al.

(10) Patent No.: US 10,506,907 B2
(45) Date of Patent: Dec. 17, 2019

(54) DISHWASHER WITH CONTROLLED DRY CYCLE

(71) Applicant: WHIRLPOOL CORPORATION, Benton Harbor, MI (US)

(72) Inventors: Roger J. Bertsch, Stevensville, MI (US); Keeley M. Kabala, Elgin, IL (US); Rafael C. Melo, Joinville (BR); Alvaro Vallejo, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 146 days.

(21) Appl. No.: 15/892,600

(22) Filed: Feb. 9, 2018

(65) Prior Publication Data

US 2018/0160878 A1 Jun. 14, 2018

Related U.S. Application Data

(63) Continuation of application No. 13/596,515, filed on Aug. 28, 2012, now Pat. No. 9,895,044.

(51) Int. Cl.
*A47L 15/00* (2006.01)
*A47L 15/48* (2006.01)

(52) U.S. Cl.
CPC ..... *A47L 15/0034* (2013.01); *A47L 15/483* (2013.01); *A47L 2401/18* (2013.01); *A47L 2401/19* (2013.01); *A47L 2401/20* (2013.01); *A47L 2501/10* (2013.01)

(58) Field of Classification Search
CPC ..... A47L 15/0034; A47L 2401/18; A47L 2401/19; A47L 2401/20; A47L 2501/10
USPC ..... 34/443
See application file for complete search history.

(56) References Cited

U.S. PATENT DOCUMENTS

| | | | |
|---|---|---|---|
| 3,068,877 | A | 12/1962 | Jacobs |
| 3,658,075 | A | 4/1972 | Jacobs |
| 5,596,507 | A | 1/1997 | Jones |
| 5,682,684 | A | 11/1997 | Wentzlaff et al. |
| 7,445,013 | B2 | 11/2008 | Vanderroest et al. |
| 7,523,758 | B2 | 4/2009 | Vanderroest et al. |
| 9,895,044 | B2 * | 2/2018 | Bertsch ..... A47L 15/0034 |
| 2006/0236556 | A1 | 10/2006 | Ferguson et al. |
| 2008/0149142 | A1 | 6/2008 | Jerg et al. |
| 2010/0101613 | A1 | 4/2010 | Jerg et al. |
| 2010/0236575 | A1 | 9/2010 | Heissler et al. |
| 2010/0258145 | A1 | 10/2010 | Heissler et al. |

(Continued)

FOREIGN PATENT DOCUMENTS

| | | | |
|---|---|---|---|
| DE | 102005062938 | A1 | 7/2007 |
| DE | 102010002086 | A1 | 8/2011 |

(Continued)

OTHER PUBLICATIONS

German Search Report for Counterpart DE102013106775, dated Dec. 20, 2013.

*Primary Examiner* — Stephen M Gravini
(74) *Attorney, Agent, or Firm* — McGarry Bair PC

(57) ABSTRACT

A dishwasher configured for drying dishes with the dishwasher having a tub at least partially defining a treating chamber and a closed loop condensation system for extracting liquid from air within a treating chamber of the dishwasher and a controller configured to control the dry cycle for drying of the dishes in the treating chamber of the dishwasher.

20 Claims, 4 Drawing Sheets

(56) References Cited

U.S. PATENT DOCUMENTS

| | | | | |
|---|---|---|---|---|
| 2013/0152981 | A1 | 6/2013 | Bertsch et al. | |
| 2014/0059880 | A1* | 3/2014 | Bertsch | A47L 15/0034 34/443 |
| 2018/0160878 | A1* | 6/2018 | Bertsch | A47L 15/0034 |

FOREIGN PATENT DOCUMENTS

| | | | |
|---|---|---|---|
| DE | 102011088754 | A1 | 6/2013 |
| EP | 2168470 | B1 | 4/2011 |
| JP | 8191788 | A | 7/1996 |
| JP | 2001292949 | A | 10/2001 |
| WO | 98/33427 | A1 | 8/1998 |
| WO | 2004019750 | A1 | 3/2004 |

* cited by examiner

DISHWASHER WITH CONTROLLED DRY CYCLE

CROSS-REFERENCE TO RELATED APPLICATIONS

This application claims priority to and is a continuation of U.S. patent application Ser. No. 13/596,515, filed Aug. 28, 2012, now U.S. Pat. No. 9,895,044, which is incorporated herein by reference in its entirety.

BACKGROUND

Dishwashers can include a drying system for drying dishes in a treating chamber of the dishwasher. The drying system may include a condenser which cools the moist air in the condenser.

The moist air may be circulated from the treating chamber, through the condenser where the moisture is precipitated, then back to the treating chamber for a predetermined time to have the dishes completely dried at the end of the dry cycle.

BRIEF DESCRIPTION

An aspect of the present disclosure relates to a dishwasher including a tub at least partially defining a treating chamber, a closed loop condensation system including a dry air conduit having a portion in overlying relationship with a portion of a moist air conduit and where the dry air conduit is fluidly separate from the treating chamber and the moist air conduit, and where the moist air conduit is fluidly coupled to the treating chamber, and where overlying portions of the moist air conduit and the dry air conduit are configured to form a heat exchanger, and the heat exchanger is configured to precipitate moisture from treating chamber air in the moist air conduit, a first temperature sensor within the dry air conduit of the closed loop condensation system upstream of the heat exchanger or operably coupled to the portion of the dry air conduit that is in overlying relationship with the portion of the moist air conduit and outputting a signal indicative of an external air temperature value, a second temperature sensor outputting a signal indicative of a temperature of the treating chamber air to define a treating chamber air temperature, a fan having a first stage fluidly coupled to the moist air conduit and configured to pull moist air from the treating chamber into the moist air conduit to define a circulation, and a controller operably coupled to the first temperature sensor, second temperature sensor, and the fan, the controller configured to receive the signal indicative of an external air temperature value, receive the signal indicative of the treating chamber air temperature, determine a difference value indicative of a temperature difference between the external air temperature value and the treating chamber air temperature, set a circulating time based on the difference value and operate the fan to circulate the treating chamber air through the moist air conduit and the heat exchanger and back through the treating chamber in the closed loop condensation system for the circulating time while supplying external air over the heat exchanger while the heat exchanger removes liquid from the circulating treating chamber air.

DETAILED DESCRIPTION

Figure 1:
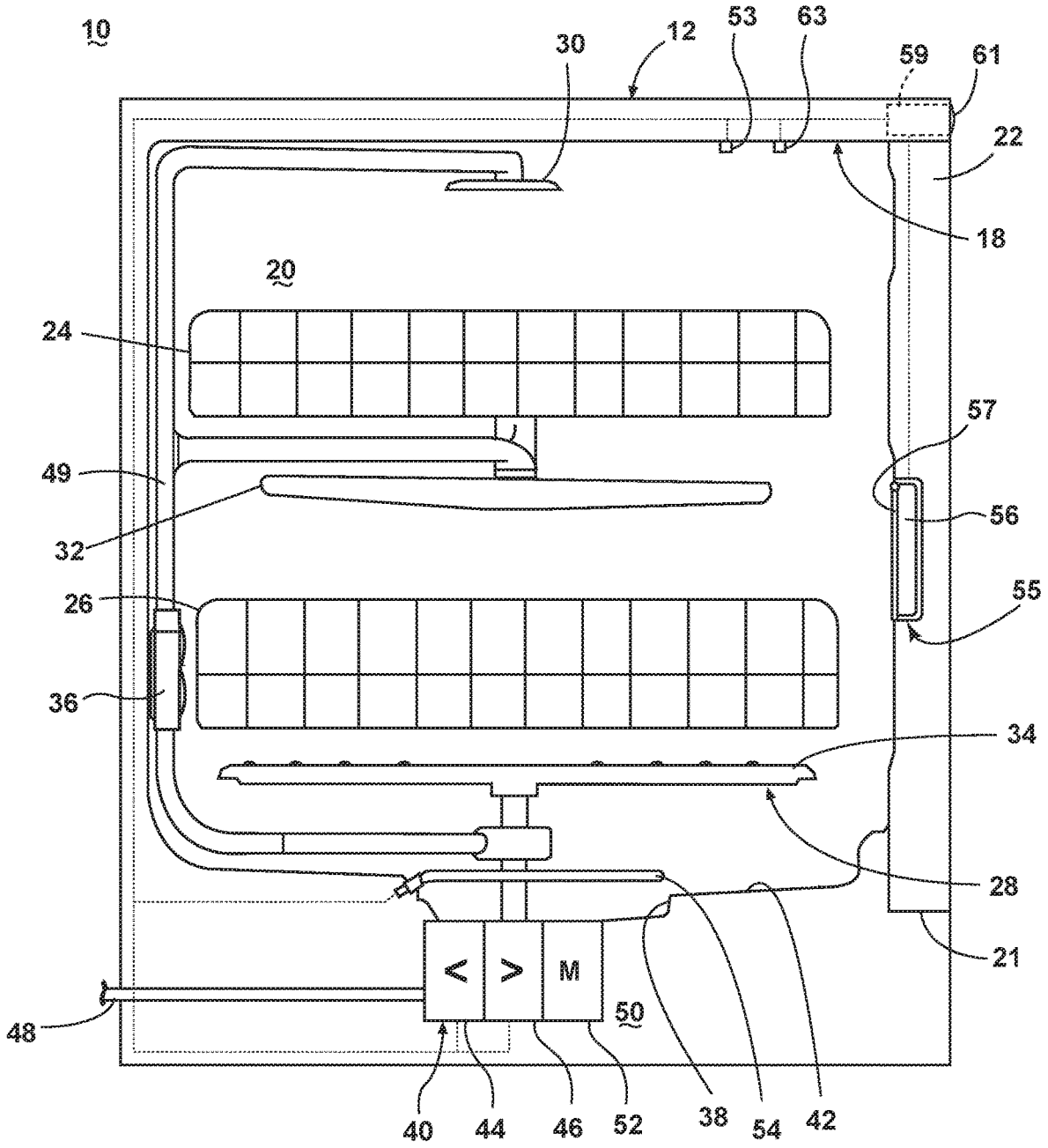
FIG. 1 is a schematic, side view of a dishwasher according to one embodiment of the invention.

FIG. 1 is a schematic, side view of a dishwasher 10 according to one embodiment of the invention. The dishwasher 10 shares many features of a conventional automated dishwasher, which will not be described in detail herein except as necessary for a complete understanding of the invention. The dishwasher 10 has a housing, which may include a chassis or cabinet 12 that may define an interior of the dishwasher 10. The dishwasher housing may also include a frame (not shown), with or without panels mounted to the frame. An open-faced tub 18 may be mounted to the dishwasher housing and provided within the cabinet 12, and may at least partially define a treating chamber 20, having an open face 21 defining an access opening, for washing dishes. A door assembly 22 may be movably mounted to the dishwasher 10 for movement between opened and closed positions to selectively open and close the open face 21 of the tub 18. Thus, the door assembly 22 provides accessibility to the treating chamber 20 for the loading and unloading of dishes or other washable items. When the door assembly 22 is closed, user access to the treating chamber 20 may be prevented, whereas user access to the treating chamber 20 may be permitted when the door assembly 22 is open. While the present invention is described in terms of a conventional dishwashing unit, it could also be implemented in other types of dishwashing units, such as in-sink dishwashers, multi tub dishwashers, or drawer-type dishwashers.

Dish holders, illustrated in the form of upper and lower racks 24, 26, respectively, are located within the treating chamber 20 and receive dishes for washing. The racks 24, 26 are typically mounted for slidable movement in and out of the treating chamber 20 for ease of loading and unloading. Other dish holders may be provided, such as a silverware basket in the tub. As used in this description, the term "dish(es)" is intended to be generic to any item, single or plural, that may be treated in the dishwasher 10, including, without limitation; dishes, plates, pots, bowls, pans, glassware, and silverware. While not shown, other dish holders may be provided, such as a silverware basket on the interior of the door assembly 22 or a third level rack above the upper rack 24 may also be provided.

A spraying system 28 may be provided for spraying liquid into the treating chamber 20 and is illustrated in the form of an upper sprayer 30, a mid-level sprayer 32, a lower rotatable spray arm 34, and a spray manifold 36. The upper sprayer 30 may be located above the upper rack 24 and is illustrated as a fixed spray nozzle that sprays liquid downwardly within the treating chamber 20. Mid-level rotatable sprayer 32 and lower rotatable spray arm 34 are located, respectively, beneath upper rack 24 and lower rack 26 and are illustrated as rotating spray arms. The mid-level spray arm 32 may provide a liquid spray upwardly through the bottom of the upper rack 24. The lower rotatable spray arm 34 may provide a liquid spray upwardly through the bottom of the lower rack 26. The mid-level rotatable sprayer 32 may optionally also provide a liquid spray downwardly onto the lower rack 26, but for purposes of simplification, this will not be illustrated herein.

The spray manifold 36 may be fixedly mounted to the tub 18 adjacent to the lower rack 26 and may provide a liquid spray laterally through a side of the lower rack 26. The spray manifold 36 may not be limited to this position; rather, the spray manifold 36 may be located in virtually any part of the treating chamber 20. While not illustrated herein, the spray manifold 36 may include multiple spray nozzles having apertures configured to spray wash liquid towards the lower rack 26. The spray nozzles may be fixed or rotatable with respect to the tub 18. Suitable spray manifolds are set forth in detail in U.S. Pat. No. 7,445,013, issued Nov. 4, 2008, and titled "Multiple Wash Zone Dishwasher," and U.S. Pat. No. 7,523,758, issued Apr. 28, 2009, and titled "Dishwasher Having Rotating Zone Wash Sprayer," both of which are incorporated herein by reference in their entirety.

A liquid recirculation system may be provided for recirculating liquid from the treating chamber 20 to the spraying system 28. The recirculation system may include a sump 38 and a pump assembly 40. The sump 38 collects the liquid sprayed in the treating chamber 20 and may be formed by a sloped or recessed portion of a bottom wall 42 of the tub 18. The pump assembly 40 may include both a drain pump 44 and a recirculation pump 46.

The drain pump 44 may draw liquid from the sump 38 and pump the liquid out of the dishwasher 10 to a household drain line 48. The recirculation pump 46 may draw liquid from the sump 38, and the liquid may be simultaneously or selectively pumped through a supply tube 49 to each of the spray assemblies 30, 32, 34, 36 for selective spraying. While the pump assembly 40 is illustrated as having separate drain and recirculation pumps 44, 46 in an alternative embodiment, the pump assembly 40 may include a single pump configured to selectively supply wash liquid to either the spraying system 28 or the drain line 48, such as by configuring the pump to rotate in opposite directions, or by providing a suitable valve system. While not shown, a liquid supply system may be fluidly coupled with the recirculation system, and may include a water supply conduit coupled with a household water supply for supplying water to the treating chamber 20.

A motor compartment 50 may be provided beneath the sump 38 and may be separated from the treating chamber 20 by the bottom wall 42. The motor compartment 50 contains one or more heat-emitting component(s), shown herein as including the pump assembly 40 and at least one motor 52 for driving the pump assembly 40. Other heat-emitting components can also be included in the motor compartment 50, such as additional motors and controllers. As shown herein, a single motor 52 can be configured to drive both the drain pump 44 and the recirculation pump 46. Alternatively, separate motors can be provided for the drain pump 44 and the recirculation pump 46. The heat-emitting components, like the pump assembly 40 and motor 52, emit heat that warms the surrounding air to create warm air within the motor compartment 50.

A heating system including a heater 54 may be located within or near the sump 38 for heating liquid contained in the sump 38. Alternatively, the heater 54 may be located within the motor compartment 50 for heating liquid flowing into or out of the recirculation pump 46. In the latter case, the heater 54 would be considered a heat-emitting component. A filtering system (not shown) may be fluidly coupled with the recirculation flow path for filtering the recirculated liquid.

A dispensing system may be provided for storing and dispensing treating chemistry to the treating chamber 20. As shown herein, the dispensing system can include a dispenser 55 mounted on an inside surface of the door assembly 22 such that the dispenser 55 is disposed in the treating chamber 20 when the door assembly 22 is in the closed position. The dispenser 55 is configured to dispense treating chemistry to the dishes within the treating chamber 20. The dispenser 55 can have one or more compartments 56 closed by a door 57 on the inner surface of the door assembly 22. The dispenser 55 can be a single use dispenser which holds a single dose of treating chemistry, a bulk dispenser which holds a bulk supply of treating chemistry and which is adapted to dispense a dose of treating chemistry from the bulk supply during a cycle of operation, or a combination of both a single use and bulk dispenser. The dispenser 55 can further be configured to hold multiple different treating chemistries. For example, the dispenser 55 can have multiple compartments defining different chambers in which treating chemistries can be held. While shown as being disposed on the door assembly 22, other locations of the dispenser 55 are possible.

One or more sensors may be provided to the dishwasher 10 to monitor and determine the status of a cycle of operation in the treating chamber 20. For example, one or more temperature sensors 53 to determine the temperature of air in the treating chamber 20 or in the motor compartment 50 and a humidity sensor 63 to determine the humidity and ending absolute humidity of air in the treating chamber 20 have been illustrated. Other sensors such as a turbidity sensor may also be included.

A controller 59 may also be included in the dishwasher 10, which may be operably coupled with various controllable components of the dishwasher 10 to implement a cycle of operation. The controller 59 may be located within the cabinet 12 as illustrated, or it may alternatively be located elsewhere such as the door assembly 22. A control panel or user interface 61 may be provided on the dishwasher 10 and coupled with the controller 59 for receiving user-selected inputs and communicating information to the user. The user interface 61 may include operational controls such as dials, lights, switches, and displays enabling a user to input commands, such as a cycle of operation, to the controller 59, and receive information.

Figure 2:
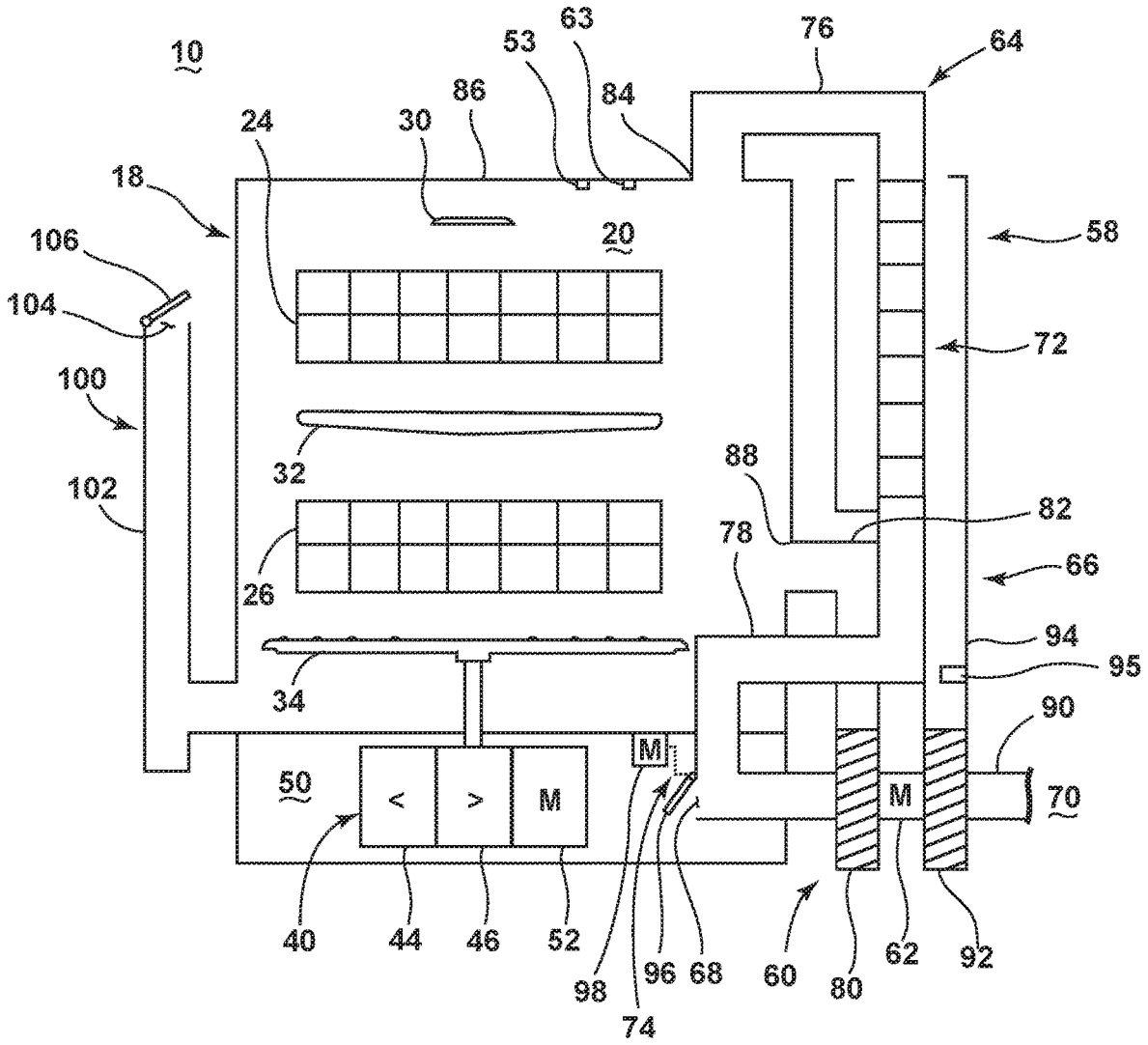
FIG. 2 is a schematic, front view of the dishwasher of FIG. 1.

FIG. 2 is a schematic, front view of the dishwasher 10 of FIG. 1. A closed loop drying system may be provided for removing moisture from the treating chamber 20 during a dry cycle of the dishwasher 10. The drying system includes a condensation system in the form of a closed loop condenser 58 having a fan 60 driven by a motor 62, a moist air conduit 64, and a dry air conduit 66. The moist air conduit 64 fluidly couples one portion of the treating chamber 20 to the other portion of the treating chamber 20, and includes a warm air inlet 68 selectively fluidly coupled to the warm air created by at least one of the heat-emitting component(s) within the motor compartment 50. Alternatively, the inlet 68 can be selectively fluidly coupled to warm air from a heat-emitting component outside the motor compartment 50 or in another location in the dishwasher 10. The dry air conduit 66 is fluidly coupled to the ambient air 70 (i.e. air from the environment exterior of the dishwasher 10) and includes a portion in overlying relationship with a portion of the moist air conduit 64, wherein the overlying portions of the moist air conduit 64 and the dry air conduit 66 form a heat exchanger 72 to cool the moist air in the moist air conduit 64 and thereby precipitate the moisture from the moist air. The dry air conduit 66 is fluidly separate from the treating chamber 20 and the moist air conduit 64. A controllable gate 74 selectively opens the warm air inlet 68 of the moist air conduit 64 to effect a supply of the warm air to the moist air conduit 64, wherein the warm air may be supplied to the treating chamber 20.

The moist air conduit 64 includes an inlet segment 76 upstream of the heat exchanger 72, an intermediate segment 78 downstream of the heat exchanger 72 and upstream of a first stage 80 of the fan 60, and an outlet segment 82 downstream of the first stage 80. The inlet segment 76 includes an inlet opening 84 in fluid communication with a first portion treating chamber 20 for delivering moist air from the treating chamber 20 to the heat exchanger 72. As shown herein, the inlet opening 84 can be formed in an upper wall 86 of the tub 18, although other locations are possible. The intermediate segment 78 extends from the heat exchanger 72 to the first stage 80 of the fan 60. A portion of the intermediate segment 78 can extend through the motor compartment 50, and can include the warm air inlet 68 and controllable gate 74 to position the inlet 68 in selective fluid communication with the warm air with the motor compartment 50. The outlet segment 82 includes an outlet opening 88 in fluid communication with a second portion of the treating chamber 20 for delivering warm air to the treating chamber 20 from the motor compartment 50. By "warm air", it is meant that the air is at a higher temperature than the ambient air 70. Typically, the air in the motor compartment is approximately 4° C. warmer than the ambient air 70, at least when the gate 74 is initially opened. The warm air is also normally dryer than the air in the treating chamber 20, at least when the gate 74 is initially opened.

The dry air conduit 66 includes an inlet segment 90 upstream of a second stage 92 of the fan 60 and an outlet segment 94 downstream of the second stage 92. The inlet segment 90 is in fluid communication with the ambient air 70 in order to supply dry air to the heat exchanger 72, which is formed by a portion of the outlet segment 94 that extends over a portion of the moist air conduit 64. By "dry air", it is meant that the air has a lower moisture content relative to the air in the treating chamber 20. The dry air is also normally cooler and has a lower temperature than the air in the treating chamber 20.

One or more temperature sensors 95 may be provided to the condenser 58 to determine the ambient air temperature flowing into the condenser 58. The temperature sensors 95 may be positioned in the outlet segment 94 as set forth in FIG. 2, or positioned in other location of the dry air conduit 66, such as the inlet segment 90. The temperature sensors 95 may be positioned in the condenser 58 such that the ambient air entering the condenser fluidly couples with the temperature sensors 95 before the ambient air is fluidly coupled to the humid air through the condenser wall.

The controllable gate 74 can comprise a valve 96 for closing the warm air inlet 68 and a motor 98 for driving the movement of the valve 96. The motor 98 can be a wax motor or any other suitable type of motor for moving the valve 96. The motor 98 can be coupled with the controller 14 (FIG. 1) for selectively opening and closing the warm air inlet 68.

The closed loop dry system is set forth in detail in the U.S. application Ser. No. 13/327,083, filed Dec. 15, 2011, and titled "Dishwasher with Closed Loop Condenser," which is incorporated herein by reference in their entirety.

The dishwasher 10 can further include a regeneration system 100 for regenerating softening agents used by a water softener (not shown) and having a regeneration tank 102 in fluid communication with the treating chamber 20. The regeneration tank 102 can include a vent 104 that is fluidly coupled with the ambient air 70 which permits excess air in the regeneration tank 102 or treating chamber 20 to be exhausted from the dishwasher 10. The vent 104 can be pressure-activated or can be selectively closed by a controllable closure means, such as a valve 106. Alternatively, if no regeneration system is provided with the dishwasher 10, excess air in the treating chamber 20 can be exhausted from the dishwasher 10 via seals around the door 22 (FIG. 1), which can be configured to open at a certain pressure differential between the treating chamber 20 and the environment, or other openings in the cabinet 12.

Figure 3:
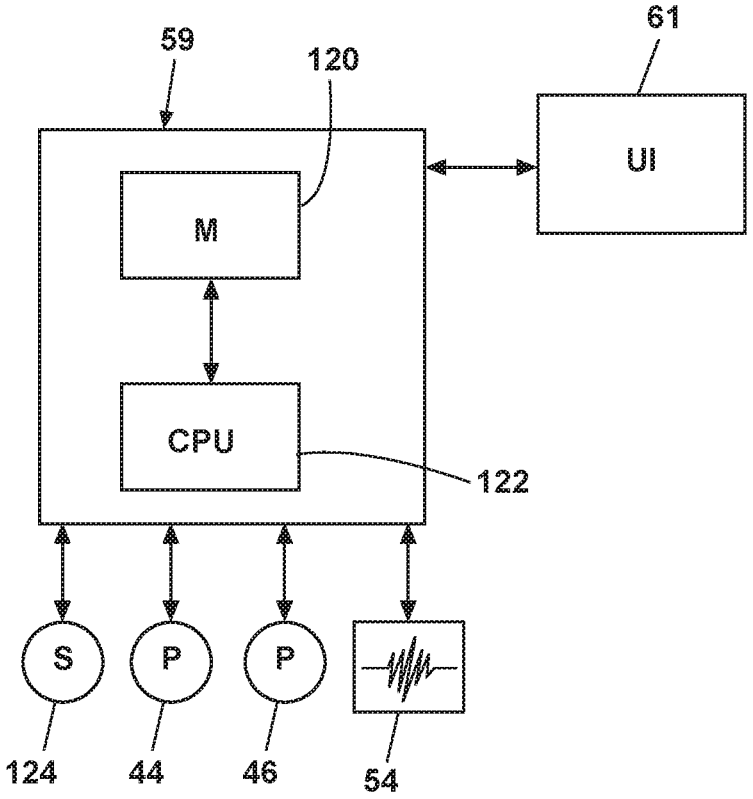
FIG. 3 is a schematic view of a controller of the dishwasher of FIG. 1.

As illustrated schematically in FIG. 3, the controller 59 may be coupled with at least one controllable component configured to implement an automatic cycle of operation, non-limiting examples of which include the heater 54 for heating the wash liquid during a cycle of operation, the drain pump 44 for draining liquid from the treating chamber 20, and the recirculation pump 46 for recirculating the wash liquid during a cycle of operation. The controller 59 may be provided with a memory 120 and a central processing unit (CPU) 122. The memory 120 may be used for storing control software that may be executed by the CPU 122 in completing a cycle of operation using the dishwasher 10 and any additional software. For example, the memory 120 may store one or more pre-programmed cycles of operation that may be selected by a user and completed by the dishwasher 10. The controller 59 may also receive input from one or more sensors 124. Non-limiting examples of sensors that may be communicably coupled with the controller 59 include temperature sensors to determine both the ambient air temperature and treating chamber air temperature, a humidity sensor to determine the absolute humidity and the ending absolute humidity in the interior of the treating chamber, and a turbidity sensor to determine the soil load associated with a selected grouping of dishes, such as the dishes associated with a particular area of the treating chamber.

In operation, moist air is formed in the treating chamber 20 by a washing, rinsing, or sanitizing cycle. To dry the dishes, a dry cycle can be initiated, in which the first stage 80 of the fan 60 pulls moist air from the treating chamber 20 into the moist air conduit 64 via the inlet opening 84, and the second stage 92 of the fan 60 pulls dry air from the ambient air 70 into the dry air conduit 66. The moist air passes through the heat exchanger 72, which precipitates moisture from the moist air. The condensed moisture drips down from the heat exchanger 72 and back into the tub 18, and can thereafter be drained from the dishwasher 10.

The controllable gate 74 can be opened to allow warm air from a heat-emitting component, such as the pump assembly 40 and/or motor 52, in the motor compartment 50 to enter the moist air conduit 64, and be passed into the treating chamber 20. The warm air can have a lower humidity than the moist air, and can help evaporate any remaining moisture on dishes in the treating chamber 20 by absorbing some of the humidity in the moist air. As warm air is introduced into the moist air conduit 64, and thus into the treating chamber 20, excess air in the treating chamber 20 may be exhausted via the vent 104 of the regeneration system 100 or through other openings in the treating chamber 20.

The efficiency of the condensation depends on a temperature difference between the moist air conduit 64 and the dry air conduit 66. At the beginning of the dry cycle, the moist air can have a temperature of approximately 45-68° C. This temperature may be dependent on the regulations of the geographical region in which the dishwasher 10 is installed; for example, a dishwasher in the United States may have a higher moist air temperature than a dishwasher in Europe at the beginning to a dry cycle. As the temperature of the moist air within the treating chamber 20 decreases (i.e. as it approaches the temperature of the ambient air 70), which will happen naturally due to heat transfer to the exterior of the dishwasher 10 after the washing, rinsing, or sanitizing cycle ends, the temperature difference decreases, lowering the efficiency of the condenser 58. This increases the length of time needed to dry the dishes in the treating chamber.

During the operation of the dishwasher having the closed loop drying system, the drying or moisture removal performance of the condenser 58 may be represented by the rate at which moisture may be condensed from the moist air in the treating chamber, which may be quantified as a moisture removal value. The moisture removal value may be represented, as set forth in the following equation (1):

$$m_{moist} = \frac{A_s \cdot h_{co} \cdot \Delta T \cdot t}{Q_{moist}} \quad (1)$$

where $m_{moist}$ is a moisture removal value, $A_s$ is a heat exchanger surface area, $\Delta T = T_1 - T_2$, a difference value, which may be a temperature difference between the treating chamber air temperature $T_1$ and the condenser wall temperature which is close to ambient air temperature $T_2$, since the condenser walls are cooled using the ambient air. $h_{co}$ is a convention heat transfer coefficient for heat exchanger, $Q_{moist}$ is a specific enthalpy of evaporation, and has a value of 2.257×103 Ws/g. t is a circulating time.

It may be clear from equation (1) that the moisture removal value is in a proportional relationship with the difference value. Typically, the greater the difference value, the higher the moisture removal value. The moisture removal value may be determined based on the difference value. With the moisture removal value and the difference value determined, the circulating time may be determined.

The moisture removal value may be expressed in an alternative way. For example, the moisture removal value may be represented as the change of humidity over a predetermined time period, where the predetermined time period may be a circulating time. If we obtain information about the change of humidity in terms of absolute humidity and ending absolute humidity, and the moisture removal value determined from the difference value, then the circulating time may be calculated.

In either way, it is understood that the circulating time may be calculated based on the moisture removal value, which depends from the difference value, $T_1 - T_2$. While the treating air temperature $T_1$ may be determined by the temperature sensor in the treating chamber, the ambient air temperature $T_2$ may be a factory default set value, similar to other setting values stored in the controller for operating the dishwasher according to a cycle of operation.

However, measured ambient air temperature may not be same as the standard ambient air temperature all the time, and may vary, for example, depending on the geographical region in which the dishwasher is installed and/or the location of the dishwasher, such as indoors or outdoors, or in a building with or without a heating, ventilating, and cooling system. As a result, an incorrect setting of ambient air temperature may result in the error in calculating the difference value, which may also affect the calculation of the circulating time, which may affect the drying performance.

If the measured ambient air temperature is higher than the standard ambient air temperature, the actual ΔT may be smaller, and, as a result, the moisture removal value may be also smaller than the one calculated from the standard ambient air temperature. Therefore, after the end of dry cycle, the dishes may still include high humidity, and additional time period may be necessary to complete dry cycle. Such a too short of a circulating time, will lead to insufficient drying, which can lead to user dissatisfaction, and false service calls if the user thinks the drying system has failed.

To the contrary, in case the measured ambient air temperature is lower than the standard ambient air temperature, the actual difference value ΔT may be greater than the one calculated from the factory set standard ambient air temperature. The corresponding moisture removal value may be also greater, which requires less circulating time than expected. As a result, the dishes in the treating chamber may be completely dried prior to the end of the dry cycle. This would not be desirable because unnecessarily extended dry cycle results in the waste of cycle time and electricity. Such a too long of a circulating time will lead to wasted energy without any additional drying benefit.

The invention addresses this shortcoming by providing the temperature sensor coupled to the closed loop dry system that provides the temperature difference between the treating chamber air temperature and the ambient air temperature, such that the circulating time may be determined based on the actual temperature difference, without reliance on a default or assumed temperature difference or reliance on a default or assumed ambient temperature.

Figure 4:
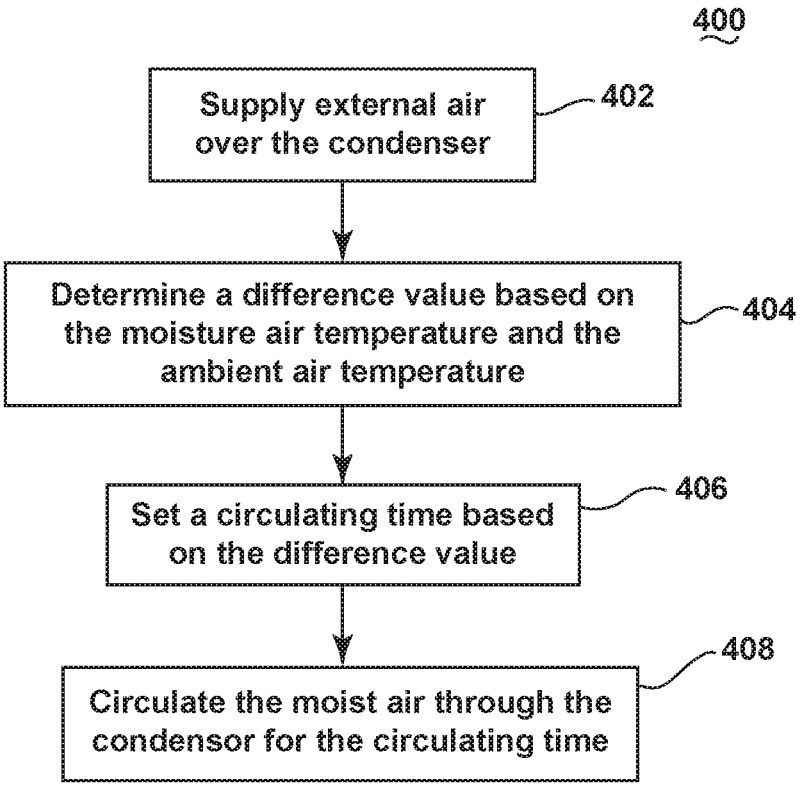
FIG. 4 is a flow chart illustrating how the drying time may be controlled in the dishwasher of FIG. 1 according to another embodiment of the invention.

FIG. 4 is a flow chart illustrating how the drying time may be controlled in the dishwasher of FIG. 1 according to another embodiment of the invention. It may be understood that the sequence of steps depicted in FIG. 4 is for illustrative purposes only, and is not meant to limit the method in any way as it is understood that the steps may proceed in a different logical order, additional or intervening steps may be included, or described steps may be divided into multiple steps, without detracting from the invention. The method of FIG. 4 may be incorporated into a cycle of operation for the dishwasher 10, such as prior to or as part of any phase of a cycle of operation. For example, the wash cycle may be completed prior to the beginning of the method of FIG. 4. Alternatively, the method of FIG. 4 may also be a stand-alone cycle. For purposes of this description, the method of FIG. 4 is being implemented when moist air is present in the treating chamber, such as after a phase in the automatic cycle of operation that results in moist air being present in the treating chamber, which could be a wash phase and/or a rinse phase.

The method of FIG. 4 may begin at 402 by supplying ambient air over the heat exchanger. When the wash cycle completes, the first stage 80 of the fan 60 begins to recirculate the moist air in the treating chamber 20 through the condenser 58. Supplying ambient air over the heat exchanger 72 may also occur to aid exchanging heat between the moist air and the ambient in the condenser 58.

At 404, a difference value indicative of the temperature difference may be determined. To determine the difference value, both the treating chamber air temperature and the ambient air temperature may be sensed by the temperature sensors 53 and 95. Sensed signals may be indicative of the treating chamber air temperature and the ambient air temperature, respectively, and may be transmitted to the controller 59, where the difference value indicative of the temperature difference may be determined by executing one or more software programs stored in the memory 120 of the controller 59. When the difference value is determined, a corresponding moisture removal value may be also determined from the look-up table or database stored in the memory 120 of the controller 59.

At 406, the circulating time may be set based on the difference value. For example, once the difference value and the corresponding moisture removal rate are determined, the circulating time may be calculated from equation (1). Other parameters, such as the heat exchanger surface area, the heat transfer coefficient for heat exchanger, the specific enthalpy of evaporation and the like, may be stored in the memory 120 of the controller 59 in calculating the circulating time using one or more software programs in the controller 59. In most instances, these parameters may be represented as individual constants or as a collective constant. Further, these parameters need not be stored at all. An equation or look-up table may be provided to establish a relationship between the temperatures and the corresponding difference value.

The circulating time may be calculated in an alternative way from the determined moisture removal value, the starting absolute humidity, and an ending absolute humidity. Prior to supplying ambient air over the heat exchanger 72, the humidity for air in the interior of the treating chamber 20 may be determined and may be qualified as the starting absolute humidity. The starting absolute humidity may be determined after wash cycle completes. For example, the starting absolute humidity for air in the treating chamber 20 may be measured by the humidity sensor when the wash cycle completes.

The humidity for air in the treating chamber 20 may typically be determined by the humidity sensor 63; however, the surface of sensing portion of the humidity sensor may be, at least, partially exposed to the water film formed during a cycle of wash operation. In that case, the humidity may be indirectly estimated from a plurality of wash cycles with known humidity information.

While the starting absolute humidity is the humidity of air right after the wash cycle completes, the ending absolute humidity may be the humidity of air in the treating chamber 20, which may be indicative of the dishes being dry. The ending absolute humidity will typically be a predetermined value, such as a value where the dishes are considered to be "dry," which is typically less than 20 g/m$^3$. Once the starting and ending absolute humidity values are selected, the circulating time may be simply determined by calculating the time in reducing the humidity from the determined humidity to the ending absolute humidity for the determined moisture removal value.

In addition to the predetermined ending absolute humidity, a rate of change of the temperature difference (a/k/a temperature drop rate) may be also used in determining the dishes are "dry." $T_1-T_2$ may be repeatedly determined from $T_1$ and $T_2$ after every predetermined time. For example, $T_1-T_2$ may be determined every one minute, and may be compared to $T_1-T_2$ determined one minute ago, to determine the temperature drop rate, $\Delta(T_1-T_2)$/minute. If the temperature drop rate is greater than a predetermine threshold, the dishes may be considered to be "dry."

At 408, when the circulating time is determined, the moist air may be circulated from the treating chamber 20, through the condenser 58, and back to the other portion of the treating chamber 20 until the circulating time passes. When the circulating time passes, the circulation stops and the dry cycle completes.

It may be noted that the recirculation of the moist air does not have to immediately follow the end of wash cycle. For example, after the wash cycle completes, the dishes in the treating chamber 20 may be under the static phase of the dry cycle, during which the fan motor 62 is not active and the dishes stand in the rack(s), to allow excess water to drip from the dishes for a given time period to lower the humidity of air in the treating chamber. The circulation of the moist air may not begin until the humidity goes down below a threshold, for example, 80-85%, when the moist air may begin to circulate the treating chamber 20, through the condenser 58, and back to the treating chamber 20 by operating the first fan stage 80. At the same time, the ambient air may be supplied over the heat exchanger 72.

While the difference value need only be determined once for the entire dry cycle, to increase the accuracy of the circulating time, the difference value may be re-determined multiple times spanning the dry cycle, with a corresponding re-determining of the remaining circulating time. Re-determining of the difference value may be especially effective when one of the treating chamber air temperature and the ambient air temperature changes significantly. For example, when the ambient air temperature goes up unexpectedly during the dry cycle, due to the malfunction of air conditioning system in the hot summer in a residential or commercial area, the difference value may get smaller than the difference value measured in the initial stage of the dry cycle, as the ambient air temperature would go up. Smaller difference value may correspond to a reduced moisture removal value. As a result, the dry cycle may require extended circulating time to compensate for the reduced moisture removal value. If the removal moisture value is not re-determined based on the actual change in the difference value, the circulating time may not be changed, and only limited dry performance would be effected. Therefore, after dry cycle, the dishes in the treating chamber would not be completely dry, and the surface of dishes may still be humid or even contain water drops, which results in the customer dissatisfaction.

The difference value and the circulating time may also be re-determined in response to a change in the system. For example, if ambient air is added to the treating chamber during the recirculation, the addition of the ambient air will form an air mixture of moist air and ambient air that will likely have a different humidity level than the moist air. In such a situation, the difference value and the circulating time may be re-determined.

When the difference value is re-determined as set forth at 404, current circulating time may be reset, and new circulating time may replace the current circulating time, to indicate the end of dry cycle. The difference value may be re-determined after passage of a predetermined time period during the dry cycle.

In the flow chart of FIG. 4, it may be noted that step 404 may not necessarily follow the step 402, while the steps 402 and 404 may occur almost at the same time. Further, the recirculation at 408 may start before the determining of the difference value and the calculation of the circulating time at 406.

The invention described herein provides methods for controlling the dry cycle of a dishwasher with the dry system in the form of the condenser. The methods of the invention can advantageously be used to controlling the dry cycle regardless of the variation in ambient air temperature. The dry cycle can be controlled by sensing the temperature of the ambient air entering into the condenser using one or more temperature sensors. By sensing the difference value indicative of the temperature difference between the treating chamber air temperature and the ambient air temperature, the circulating time can be precisely determined to have the dishes dried at the end of the dry cycle.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A dishwasher, comprising:

a tub at least partially defining a treating chamber;

a closed loop condensation system including a dry air conduit having a portion in overlying relationship with a portion of a moist air conduit and where the dry air conduit is fluidly separate from the treating chamber and the moist air conduit, and where the moist air conduit is fluidly coupled to the treating chamber, and where overlying portions of the moist air conduit and the dry air conduit are configured to form a heat exchanger, and the heat exchanger is configured to precipitate moisture from treating chamber air in the moist air conduit;

a first temperature sensor within the dry air conduit of the closed loop condensation system upstream of the heat exchanger or operably coupled to the portion of the dry air conduit that is in overlying relationship with the portion of the moist air conduit and outputting a signal indicative of an external air temperature value;

a second temperature sensor outputting a signal indicative of a temperature of the treating chamber air to define a treating chamber air temperature;

a fan having a first stage fluidly coupled to the moist air conduit and configured to pull moist air from the treating chamber into the moist air conduit to define a circulation; and a controller operably coupled to the first temperature sensor, second temperature sensor, and the fan, the controller configured to receive the signal indicative of an external air temperature value, receive the signal indicative of the treating chamber air temperature, determine a difference value indicative of a temperature difference between the external air temperature value and the treating chamber air temperature, set a circulating time based on the difference value and operate the fan to circulate the treating chamber air through the moist air conduit and the heat exchanger and back through the treating chamber in the closed loop condensation system for the circulating time while supplying external air over the heat exchanger while the heat exchanger removes liquid from the circulating treating chamber air.

2. The dishwasher of claim 1 wherein the fan further comprises a second stage fluidly coupled to the dry air conduit.

3. The dishwasher of claim 2 wherein the controller is operably coupled to the fan and the controller is further configured to supply air external to the treating chamber through the dry air conduit and over the heat exchanger.

4. The dishwasher of claim 3 wherein the air external to the treating chamber comprises ambient air surrounding the dishwasher.

5. The dishwasher of claim 1, further comprising a motor compartment separated from the treating chamber via at least one wall.

6. The dishwasher of claim 5, further comprising at least one heat-emitting component located within the motor compartment.

7. The dishwasher of claim 6 where the moist air conduit includes a warm air inlet selectively fluidly coupled to warm air within the motor compartment.

8. The dishwasher of claim 7, further comprising a controllable gate operably coupled with the warm air inlet and operably coupled to the controller and wherein the controller is configured to control a position of the controllable gate.

9. The dishwasher of claim 7 wherein the controller is further configured to re-determine the difference value after introducing the warm air and resetting the circulating time based on the re-determined difference value.

10. The dishwasher of claim 1 wherein the controller is further configured to determine an absolute humidity of the treating chamber air and setting the circulating time based on the determined absolute humidity and the difference value.

11. The dishwasher of claim 10 wherein the controller setting the circulating time based on the determined absolute humidity and the difference value comprises resetting the circulating time.

12. The dishwasher of claim 10 wherein the controller determining the absolute humidity comprises at least one of anecdotally determining the absolute humidity, estimating the absolute humidity, and sensing the absolute humidity.

13. The dishwasher of claim 10 wherein the controller is further configured to determine a moisture removal value indicative of a rate of moisture removed by the closed loop condensation system for the determined difference value, and using the moisture removal value and the determined absolute humidity to set the circulating time.

14. The dishwasher of claim 13 wherein the controller is further configured to determine an ending absolute humidity value indicative of the dishes being dried and setting the circulating time based on the time it takes to reduce the determined absolute humidity to the ending absolute humidity value for the determined moisture removal value.

15. The dishwasher of claim 1 wherein the controller is further configured to cease the circulating upon passing of the circulating time.

16. The dishwasher of claim 1 wherein the controller is further configured to re-determine the difference value and correspondingly resetting the circulating time.

17. The dishwasher of claim 1 wherein the controller determining the difference value comprises determining a rate of change of the temperature difference between the external air and the treating chamber air.

18. A dishwasher, comprising:

a tub at least partially defining a treating chamber;

a closed loop condensation system including a dry air conduit having a portion in overlying relationship with a portion of a moist air conduit and where the dry air conduit is fluidly separate from the treating chamber and the moist air conduit, and where the moist air conduit is fluidly coupled to the treating chamber, and where overlying portions of the moist air conduit and the dry air conduit are configured to form a heat exchanger, and the heat exchanger is configured to precipitate moisture from treating chamber air in the moist air conduit;

a first temperature sensor within the dry air conduit of the closed loop condensation system upstream of the heat exchanger or operably coupled to the portion of the dry air conduit that is in overlying relationship with the portion of the moist air conduit and outputting a signal indicative of an external air temperature value;

a second temperature sensor outputting a signal indicative of a temperature of the treating chamber air to define a treating chamber air temperature;

a fan having a first stage fluidly coupled to the moist air conduit and configured to pull moist air from the treating chamber into the moist air conduit to define a circulation; and a controller operably coupled to the first temperature sensor, second temperature sensor, and the fan, the controller configured to receive the signal indicative of an external air temperature value, receive the signal indicative of the treating chamber air temperature, determine an absolute humidity for air within the treating chamber, determine a difference value indicative of a temperature difference between the external air temperature value and the treating chamber air temperature, set a circulating time based on the determined absolute humidity and the difference value and operate the fan to circulate the treating chamber air through the moist air conduit and the heat exchanger and back through the treating chamber in the closed loop condensation system for the circulating time, and supply air external to the treating chamber through the dry air conduit including over the portion forming the heat exchanger during the circulating of the treating chamber air while the heat exchanger removes liquid from the circulating treating chamber air, and terminate the circulating upon passing of the circulating time.

19. The dishwasher of claim 18 wherein determining the absolute humidity comprises the controller being configured to at least one of anecdotally determining the absolute humidity, estimating the absolute humidity, and sensing the absolute humidity.

20. The dishwasher of claim 19 wherein the controller is further configured to determine an ending absolute humidity value indicative of the dishes being dried and setting the circulating time based on the time it takes to reduce the determined absolute humidity to the ending absolute humidity value.

* * * * *